US009305491B2

(12) United States Patent
Weitbruch et al.

(10) Patent No.: US 9,305,491 B2
(45) Date of Patent: Apr. 5, 2016

(54) METHOD AND APPARATUS FOR DRIVING A DISPLAY DEVICE WITH VARIABLE REFERENCE DRIVING SIGNALS

(76) Inventors: Sébastien Weitbruch, Kappel (DE); Rainer Schweer, Niedereschach (DE); Sylvain Thiebaud, Noyal sur Vilaine (FR)

( * ) Notice: Subject to any disclaimer, the term of this patent is extended or adjusted under 35 U.S.C. 154(b) by 720 days.

(21) Appl. No.: 11/821,061

(22) Filed: Jun. 20, 2007

(65) Prior Publication Data

US 2008/0055213 A1 Mar. 6, 2008

(30) Foreign Application Priority Data

Jun. 30, 2006 (EP) ..... 06300741

(51) Int. Cl.
*G09G 5/10* (2006.01)
*G09G 3/32* (2006.01)

(52) U.S. Cl.
CPC ..... *G09G 3/3233* (2013.01); *G09G 2300/043* (2013.01); *G09G 2310/027* (2013.01); *G09G 2320/0271* (2013.01); *G09G 2320/0285* (2013.01); *G09G 2360/16* (2013.01)

(58) Field of Classification Search
USPC ..... 345/204, 76, 87, 690
See application file for complete search history.

(56) References Cited

U.S. PATENT DOCUMENTS 6,023,259 A 2/2000 Howard et al.
6,535,224 B2 3/2003 Kuriyama et al.
2002/0011979 A1* 1/2002 Nitta et al. ..... 345/89
2002/0126139 A1 9/2002 Kuriyama et al.
2003/0042048 A1 3/2003 Hughes et al.
2003/0122743 A1* 7/2003 Suzuki ..... 345/63
2003/0234392 A1 12/2003 Kung et al.
2004/0051685 A1 3/2004 Chung et al.
2004/0100399 A1 5/2004 Sun
2005/0057455 A1 3/2005 Peng
2005/0104842 A1 5/2005 Baik
2005/0134534 A1* 6/2005 Yamada et al. ..... 345/63
2006/0022915 A1 2/2006 Weitbruch et al.
2006/0066756 A1 3/2006 Yamagishi et al.
2008/0316163 A1* 12/2008 Van Den Homberg et al. 345/98

FOREIGN PATENT DOCUMENTS

EP 1158779 11/2001
EP 1227467 7/2002

(Continued)

OTHER PUBLICATIONS

European Search Report dated Oct. 2, 2006.

(Continued)

*Primary Examiner* — Grant Sitta

(57) ABSTRACT

A method and an apparatus capable of increasing the video depths depending on the video content of each line in order to provide a maximum of color gradation for each given scene shall be proposed. For this purpose there is disclosed an apparatus for driving a display device including input means for receiving a digital value as video level for each pixel or cell of a line of the display device, reference signaling means for providing at least one reference driving signal and driving means for generating a driving signal on the basis of the digital value and the at least one reference driving signal. The apparatus further includes adjusting means for adjusting the at least one reference driving signal in dependence of the digital values of at least a part of the line.

10 Claims, 7 Drawing Sheets

(56) References Cited

FOREIGN PATENT DOCUMENTS

| | | |
|---|---|---|
| EP | 1469449 | 10/2004 |
| EP | 1622119 | 2/2006 |
| GB | 2388236 | 11/2003 |
| JP | H06230760 | 8/1994 |
| JP | 2000242210 | 9/2000 |
| JP | 2002251171 | 9/2002 |
| JP | 2003162253 | 6/2003 |
| JP | 2004037828 | 2/2004 |
| JP | 2004220049 | 8/2004 |
| JP | 2004333570 | 11/2004 |
| JP | 2004341267 | 12/2004 |
| JP | 2004354635 | 12/2004 |
| JP | 2004361489 | 12/2004 |
| JP | 2005148710 | 6/2005 |
| JP | 2005260329 | 9/2005 |
| JP | 2006048040 | 2/2006 |
| JP | 2006101421 | 4/2006 |
| JP | 2007199375 | 8/2007 |
| JP | 2007199376 | 8/2007 |
| WO | WO2004088568 | 10/2004 |

OTHER PUBLICATIONS

Landsburg et al, "Flat screen displays using OLEDs (organic light emitting diodes)," Elektronik Praxis, No. 1, pp. 50-54, Jan. 15, 2002. (Abstract).

Lin, et al., "Current driving pixel circuitries for active matrix organic light emitting diode display," 2002 SID Int'l Symposium. Digest of Technical Papers, vol. 33, pt. vol. 1, pp. 610-613, San Jose, May 2002.

Lin, et al., "Improvement of brightness uniformity by AC driving scheme for AMOLED display," IEEE Electron Device Letters, vol. 25, No. 11, pp. 728-730, Nov. 2004.

Sempel, et al., "Design aspects of low power polymer/OLED passive-matrix displays," Organic Electronics, vol. 3, No. 2, pp. 89-92, Jun. 2002.

* cited by examiner

METHOD AND APPARATUS FOR DRIVING A DISPLAY DEVICE WITH VARIABLE REFERENCE DRIVING SIGNALS

This application claims the benefit, under 35 U.S.C. §119 of European Patent Application 06/300741.3, filed Jun. 30, 2006.

FIELD OF THE INVENTION

The present invention relates to a method for driving a display device including the steps of providing a digital value as video level for each pixel or cell of a line of the display device, providing at least one reference driving signal and generating a driving signal on the basis of the digital value and the at least one reference driving signal. Furthermore, the present invention relates to a respective apparatus for driving a display device.

BACKGROUND OF THE INVENTION

The structure of an active matrix OLED (organic light emitting display) or AMOLED is well known. According to FIG. 1 it comprises:

- an active matrix 1 containing, for each cell (one pixel includes a red cell, a green cell and a blue cell), an association of several TFTs T1, T2 with a capacitor C connected to an OLED material. Above the TFTs the capacitor C acts as a memory component that stores a value during a part of the video frame, this value being representative of a video information to be displayed by the cell 2 during the next video frame or the next part of the video frame. The TFTs act as switches enabling the selection of the cell 2, the storage of a data in the capacitor C and the displaying by the cell 2 of a video information corresponding to the stored data;
- a row or gate driver 3 that selects line by line the cells 2 of the matrix 1 in order to refresh their content;
- a column or source driver 4 that delivers the data to be stored in each cell 2 of the current selected line; this component receives the video information for each cell 2; and
- a digital processing unit 5 that applies required video and signal processing steps and that delivers the required control signals to the row and column drivers 3, 4.

Actually, there are two ways for driving the OLED cells 2. In a first way, each digital video information sent by the digital processing unit 5 is converted by the column drivers 4 into a current whose amplitude is directly proportional to the video level. This current is provided to the appropriate cell 2 of the matrix 1. In a second way, the digital video information sent by the digital processing unit 5 is converted by the column drivers 4 into a voltage whose amplitude is proportional to the square of the video level. This current or voltage is provided to the appropriate cell 2 of the matrix 1.

However, in principle, an OLED is current driven so that each voltage based driven system is based on a voltage to current converter to achieve appropriate cell lighting.

From the above, it can be deduced that the row driver 3 has a quite simple function since it only has to apply a selection line by line. It is more or less a shift register. The column driver 4 represents the real active part and can be considered as a high level digital to analog converter.

The displaying of a video information with such a structure of AMOLED is symbolized in FIG. 2. The input signal is forwarded to the digital processing unit that delivers, after internal processing, a timing signal for row selection to the row driver synchronized with the data sent to the column driver 4. The data transmitted to the column driver 4 are either parallel or serial. Additionally, the column driver 4 disposes of a reference signaling delivered by a separate reference signaling device 6. This component 6 delivers a set of reference voltages in case of voltage driven circuitry or a set of reference currents in case of current driven circuitry. The highest reference is used for the white and the lowest for the smallest gray level. Then, the column driver 4 applies to the matrix cells 2 the voltage or current amplitude corresponding to the data to be displayed by the cells 2.

In order to illustrate this concept, the example of a voltage driven circuitry will be taken in the rest of this document. The driver of this example uses 8 reference voltages named V0 to V7 and the video levels are built as explained in the following table 1.

TABLE 1

Gray level table from voltage driver

| Video level | Grayscale voltage level |
|---|---|
| 0 | V7 |
| 1 | V7 + (V6 − V7) × 9/1175 |
| 2 | V7 + (V6 − V7) × 32/1175 |
| 3 | V7 + (V6 − V7) × 76/1175 |
| 4 | V7 + (V6 − V7) × 141/1175 |
| 5 | V7 + (V6 − V7) × 224/1175 |
| 6 | V7 + (V6 − V7) × 321/1175 |
| 7 | V7 + (V6 − V7) × 425/1175 |
| 8 | V7 + (V6 − V7) × 529/1175 |
| 9 | V7 + (V6 − V7) × 630/1175 |
| 10 | V7 + (V6 − V7) × 727/1175 |
| 11 | V7 + (V6 − V7) × 820/1175 |
| 12 | V7 + (V6 − V7) × 910/1175 |
| 13 | V7 + (V6 − V7) × 998/1175 |
| 14 | V7 + (V6 − V7) × 1086/1175 |
| 15 | V6 |
| 16 | V6 + (V5 − V6) × 89/1097 |
| 17 | V6 + (V5 − V6) × 173/1097 |
| 18 | V6 + (V5 − V6) × 250/1097 |
| 19 | V6 + (V5 − V6) × 320/1097 |
| 20 | V6 + (V5 − V6) × 386/1097 |
| 21 | V6 + (V5 − V6) × 451/1097 |
| 22 | V6 + (V5 − V6) × 517/1097 |
| . . . | . . . |
| | V1 + (V0 − V1) × 2278/3029 |
| 251 | V1 + (V0 − V1) × 2411/3029 |
| 252 | V1 + (V0 − V1) × 2549/3029 |
| 253 | V1 + (V0 − V1) × 2694/3029 |
| 254 | V1 + (V0 − V1) × 2851/3029 |
| 255 | V0 |

Table 1 illustrates the obtained output voltages (gray scale voltage levels) from the voltage driver for various input video levels. For instance, the reference voltages of Table 2 are used.

TABLE 2

Example of voltage references

| Reference Vn | Voltage (V) |
|---|---|
| V0 | 3 |
| V1 | 2.6 |
| V2 | 2.2 |
| V3 | 1.4 |
| V4 | 0.6 |
| V5 | 0.3 |
| V6 | 0.16 |
| V7 | 0 |

Then, the grayscale voltage levels of following Table 3 depending on video input levels according to Table 1 and Table 2 are obtained:

TABLE 3

| Example of gray level voltages | |
|---|---|
| Video level | Grayscale voltage level |
| 0 | 0.00 V |
| 1 | 0.001 V |
| 2 | 0.005 V |
| 3 | 0.011 V |
| 4 | 0.02 V |
| 5 | 0.032 V |
| 6 | 0.045 V |
| 7 | 0.06 V |
| 8 | 0.074 V |
| 9 | 0.089 V |
| 10 | 0.102 V |
| 11 | 0.115 V |
| 12 | 0.128 V |
| 13 | 0.14 V |
| 14 | 0.153 V |
| 15 | 0.165 V |
| 16 | 0.176 V |
| 17 | 0.187 V |
| 18 | 0.196 V |
| 19 | 0.205 V |
| 20 | 0.213 V |
| 21 | 0.221 V |
| 22 | 0.229 V |
| ... | ... |
| 250 | 2.901 V |
| 251 | 2.919 V |
| 252 | 2.937 V |
| 253 | 2.956 V |
| 254 | 2.977 V |
| 255 | 3.00 V |

As can be seen in the previous paragraph current AMOLED concepts are capable of delivering 8-bit gradation per color. This can be further enhanced by using more advanced solutions like improvements on analog sub-fields.

In any case, there will be the need in the future of displays having more video-depth. This trend can be seen in the development of transmission standards based on 10-bit color channels. At the same time, various display manufacturers like PDP makers are claiming providing displays with more than 10-bit color-depth.

SUMMARY OF THE INVENTION

The object of the present invention is to provide a method and an apparatus capable of increasing the video depth depending on the video content of each line in order to provide a maximum of color gradation for a given scene. I.e., a line content picture enhancement shall be provided.

According to the present invention this object is solved by a method for driving a display device including the steps of

- providing a digital value as video level for each pixel or cell of a line of said display device,
- providing at least one reference driving signal and
- generating a driving signal on the basis of said digital value and said at least one reference driving signal, as well as
- adjusting said video level and said at least one reference driving signal in dependence of the digital values of at least a part of said line.

Furthermore, there is provided an apparatus for driving a display device including

- input means for receiving a digital value for each pixel or cell of a line of said display device,
- reference signaling means for providing at least one reference driving signal and
- driving means for generating a driving signal on the basis of said digital value and said at least one reference driving signal, as well as
- adjusting means for adjusting said video level and said at least one reference driving signal in dependence of the digital values of at least a part of said line.

Preferably, the display device is an AMOLED or a LCD. Especially, these display concepts can be improved by the above described method or apparatus.

The reference driving signal may be a reference voltage or a reference current. Each of these driving systems can profit from the present invention.

According to a further preferred embodiment, a maximum digital value of at least the part of a line is determined and when adjusting the reference driving signals, they are assigned to digital values between a minimum digital value, which is to be determined or is predetermined, and a maximum digital value. By this way, the whole range of gray scale levels is used for the video input of one line.

A further improvement can be obtained when determining a histogram of the digital values of at least the part of a line and adjusting the reference driving signals on the basis of this histogram. This results in an enhanced picture line-dependent gradation.

BRIEF DESCRIPTION OF THE DRAWINGS

Exemplary embodiments of the invention are illustrated in the drawings showing in.

DETAILED DESCRIPTION OF PREFERRED EMBODIMENTS

Figure 1:
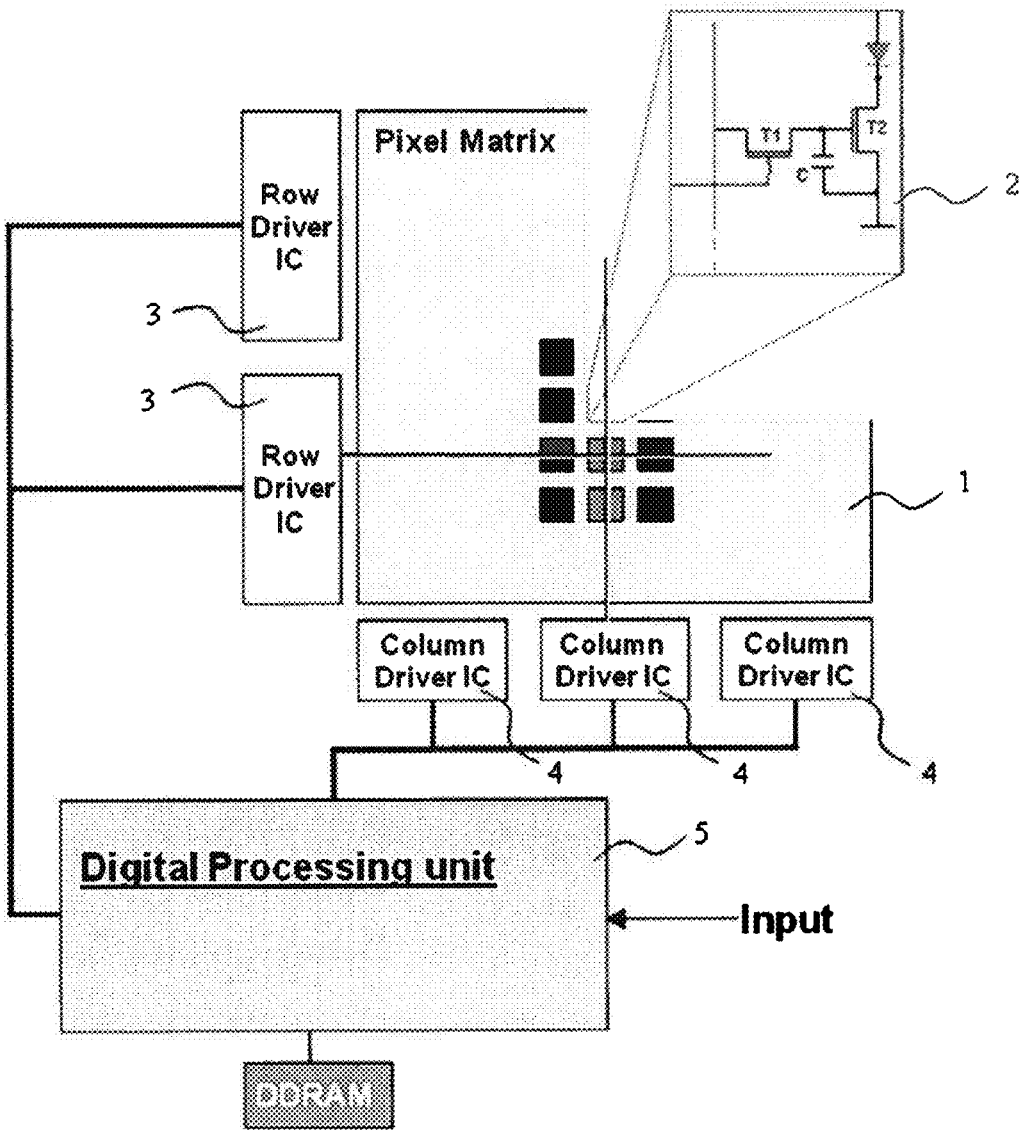
Fig. 1 Prior Art
FIG. 1 a circuit diagram of an AMOLED electronic according to the prior art.
Figure 2:
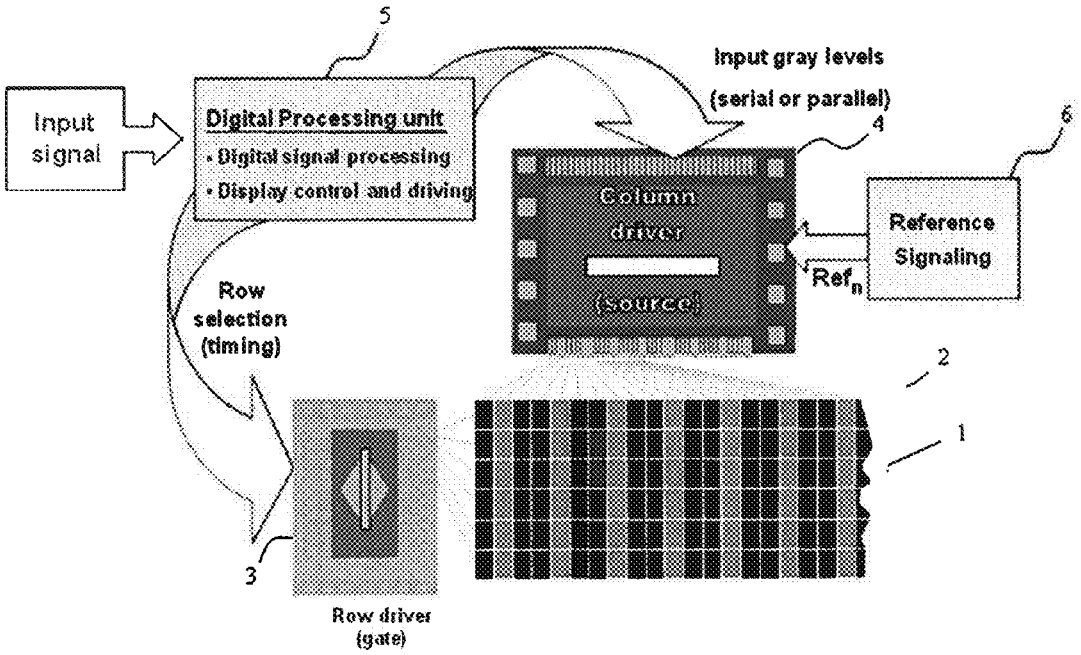
Fig. 2 Prior Art
FIG. 2 a possible OLED display structure according to the prior art.
Figure 3:
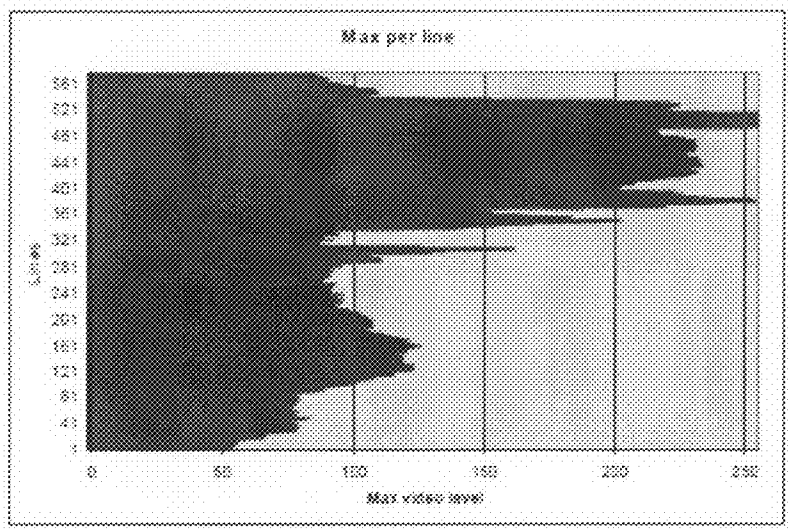
FIG. 3 a sequence of the movie "Zorro" and a corresponding line analysis diagram.
Figure 3:
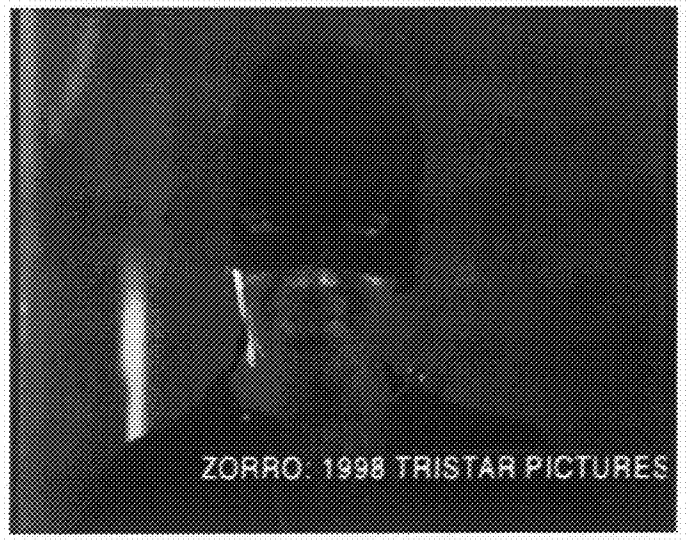
Figure 4:
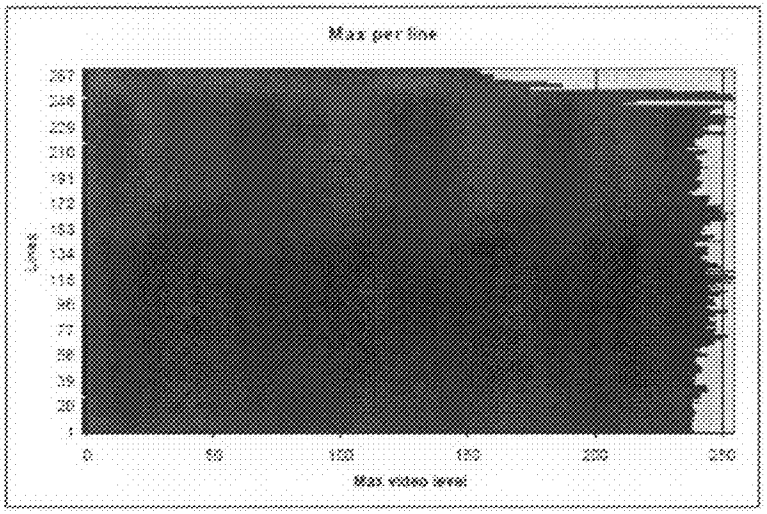
FIG. 4 a sequence of a Colombia movie and a corresponding line analysis diagram.
Figure 4:
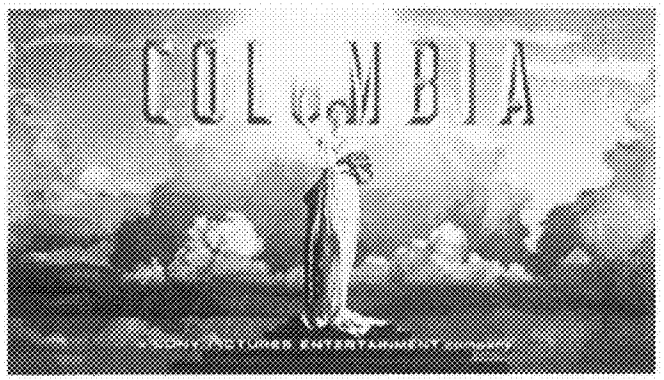

The main idea behind the inventive concept is based on the fact that in a video scene, the whole video dynamic range is not used on a large part of the scene. FIGS. 3 and 4 show typical examples for frames of different dynamics. FIG. 3 shows a dark picture of the movie "Zorro". The picture has the format 4:3 with 561 lines. On the right hand side of FIG. 3 the maximum video level of each line is plotted.

FIG. 4 shows a picture of a Colombia film. The picture has the format 16:9 with 267 lines. The right hand side diagram of FIG. 4 illustrates that nearly each line is driven with a maximum video level.

Together, FIGS. 3 and 4 show that for some sequences there are strong differences in the vertical distribution of video levels. The most differences are located in dark scenes with some luminous content as illustrated by the sequence "Zorro".

On the other hand, it is important to notice that in dark scenes the eye is much more sensitive to picture gradation. Therefore, an optimization of picture gradation for dark scenes while keeping luminous scenes quite stable would have a positive effect on the global picture quality.

As already explained, the main idea is to perform a picture line-dependent gradation by optimizing the driver reference signaling (voltage or current) to the maximum of video levels available in a line. For instance, in the sequence "Zorro" of FIG. 3, the maximum video level for line 303 is 128. Therefore, if nothing is done, from the 8-bit of available gradations (0 to 255), only 7 are used for this line (0 to 128). However, according to the present invention, the 8-bit gradation for video levels between 0 and 128 will be used. In order to do that, the reference signaling of the driver is adjusted to these 129 levels. In the present example of a voltage driven system the maximum voltage level will be adjusted to the 129/256 of the original one and all other voltages accordingly. This is illustrated in following Table 4:

TABLE 4

Example of adjusted voltage references for line 303

| Reference Vn | Line 303 Voltage (Vn) | Original Voltage (Vrefn) |
|---|---|---|
| V0 | 1.5 | 3 |
| V1 | 1.3 | 2.6 |
| V2 | 1.1 | 2.2 |
| V3 | 0.7 | 1.4 |
| V4 | 0.3 | 0.6 |
| V5 | 0.15 | 0.3 |
| V6 | 0.08 | 0.16 |
| V7 | 0 | 0 |

More generally, a complex function can be applied to the reference signaling under the form $S_n=f(Sref_n;MAX(Line))$ where MAX(Line) represents the maximum video level used for a given line and Srefn the reference signaling (either voltage or current). This function can be implemented by means of LUT or embedded mathematical functions.

In the example shown in Table 4, all voltages have been modified using the same transformation $$V_n = (Vref_n - Vref_7) \times \frac{\text{MAX(Line)}}{255} + Vref_7$$

where Vref0 represents the threshold voltage. This is the simplest transformation that can be used for voltage driven system since the gamma function is applied inside the OLED according to the proportionality $L(x,y) \propto I(x;y)=k\times(V(x;y)-V_{th})^2$ where L(x;y) represents the luminance of the pixel located at (x;y) and I(x,y) the current provided to this pixel. Indeed in a first approach, it is intended to have $L(x,y) \propto k\times(\text{Video}(x;y))^2$ if one could afford to have a gamma of 2 instead of a gamma of 2.2. In this case it is easy to understand that if the Video level dynamic is modified by a factor p, then it is sufficient to modify the voltages by the same factor. In all other cases, like gamma different from 2 or current driven systems where no inherent gamma is existing a more complex transformation is mandatory for the voltage adjustment since the voltages are no more proportional to the video values.

For instance, in a current driven system there is $L(x,y)=k\times(I-I_{th})$ but ideally it should be $L(x,y) \propto (\text{Video}(x;y))^{2.2}$. Then, a gamma transfer function of 2.2 is needed between the video level and the applied intensity. So if the video level is divided by 2, the provided intensity must be divided by 4.59 since $$L(x, y) \propto \left(\frac{\text{Video}(x; y)}{2}\right)^{2.2} = \frac{(\text{Video}(x; y))^{2.2}}{2^{2.2}}.$$

The same is true for a voltage driven system and a real gamma of 2.2 is aimed. In this case, there is a transformation of 1.1 between video and voltages under the form $V(x,y) \propto \text{Video}(x;y)^{1.1}$ that is needed in order to have finally:

$$L(x,y) \propto (V(x;y)-V_{th})^2 \propto (\text{Video}(x;y)^{1.1})^2 = \text{Video}(x;y)^{2.2}$$

In that case, if the maximum video is divided by 2, the voltages must be divided by $2^{1.1}=2.14$.

Such a transformation is quite complex and it is often difficult to be computed on-chip. Therefore, the ideal solution is to use a LUT containing 255 inputs, each one dedicated to a maximum value. The output can be on 8-bit or more in order to define the adjusting factor. Ideally, 10-bit is mandatory.

Reverting to the example of the current driven system, if the maximum amplitude per line is 128, the output of the 256×10-bit LUT will be 225. Then the voltages will be multiplied by 225 and divided by 1024 to obtain the factor 4.59. Here, it is very difficult to perform a division in hardware excepted if a $2^m$ divider is used that is simply a shift register. Indeed, dividing by 1024 corresponds to a shift by 10. Therefore the multiplication coefficients are always based on a $2^p$ divider. Some further examples for such a LUT are given in Table 5 below.

TABLE 5

Example of LUT for reference signalling adjustment

| MAX (Line) | LUT (Voltage driven) power of 1.1 | LUT (current driven) power of 2.2 |
|---|---|---|
| 96 | 350 | 119 |
| 97 | 354 | 122 |
| 98 | 358 | 125 |
| 99 | 362 | 128 |
| 100 | 366 | 131 |
| 101 | 370 | 133 |
| 102 | 374 | 136 |
| 103 | 378 | 139 |
| 104 | 382 | 142 |
| 105 | 386 | 145 |
| 106 | 390 | 148 |
| 107 | 394 | 152 |
| 108 | 398 | 155 |
| 109 | 402 | 158 |
| 110 | 406 | 161 |
| 111 | 410 | 164 |
| 112 | 414 | 168 |
| 113 | 418 | 171 |
| 114 | 422 | 174 |
| 115 | 426 | 178 |
| 116 | 431 | 181 |
| 117 | 435 | 184 |
| 118 | 439 | 188 |
| 119 | 443 | 191 |
| 120 | 447 | 195 |
| 121 | 451 | 199 |
| 122 | 455 | 202 |
| 123 | 459 | 206 |
| 124 | 463 | 210 |
| 125 | 467 | 213 |
| 126 | 472 | 217 |
| 127 | 476 | 221 |
| 128 | 480 | 225 |
| 129 | 484 | 229 |
| 130 | 488 | 233 |
| 131 | 492 | 237 |
| 132 | 496 | 241 |
| 133 | 500 | 245 |

TABLE 5-continued

| Example of LUT for reference signalling adjustment | | |
|---|---|---|
| MAX (Line) | LUT (Voltage driven) power of 1.1 | LUT (current driven) power of 2.2 |
| 134 | 505 | 249 |
| 135 | 509 | 253 |
| 136 | 513 | 257 |
| 137 | 517 | 261 |
| 138 | 521 | 265 |

In parallel to that the video levels must be modified accordingly to benefit of the enhanced gradation. In that case $$L_{out} = L_{in} \times \frac{255}{\text{MAX(Line)}}$$

applies. Here also the transformation should be better implemented via a LUT with 256 inputs corresponding to the 256 possible values for MAX(Line) and an output corresponding to a coefficient on 10-bit or more.

In the previous paragraph, a simple solution is shown based on adjusting the reference signaling range to the maximal available video level in a line. A more advanced concept would lead in an optimization of the gradation between the more used video levels. Such enhanced concept of picture line-dependent gradation will be based on a histogram analysis performed on each line. The example of the sequence "Zorro" and the line 303 shall be taken from such histogram analysis with the previous approach for voltage adjustment.

Figure 5:
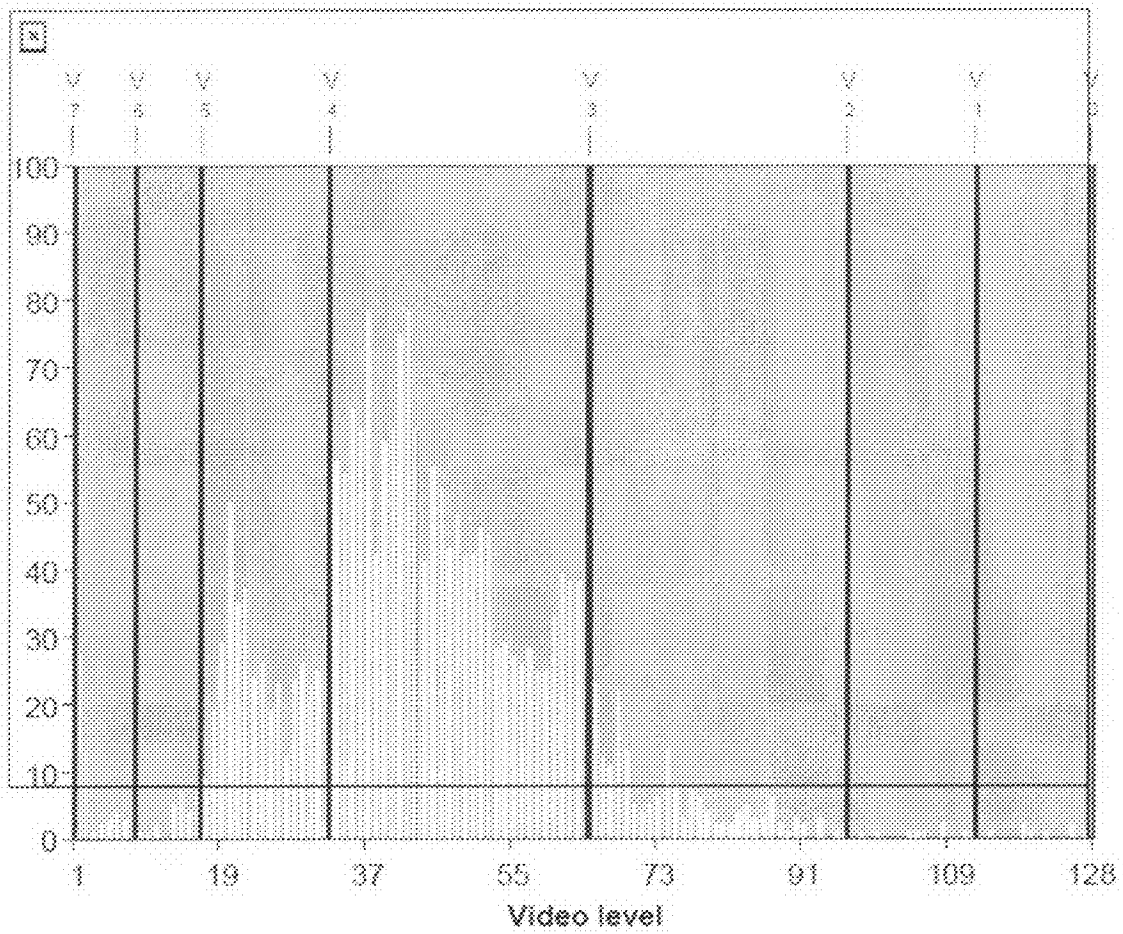
FIG. 5 a histogram of line 303 from the sequence "Zorro"

FIG. 5 shows in a histogram analysis the repartition of video levels for the line 303 of the sequence "Zorro" (FIG. 3). The vertical lines represent the new adjusted voltages from the first embodiment presented in connection with Table 4. The reference voltages are represented according to the example from Table 1 and the video level is adjusted according to the equation $$V_n = (Vref_n - Vref_0) \times \frac{\text{MAX(Line)}}{255} + Vref_0.$$

Now, for all examples simply a gamma of 2 shall be used. For this case, the new correspondence between video levels and voltages is shown in Table 6.

TABLE 6

| Adjusted gray level table from voltage driver | |
|---|---|
| Video level | Grayscale voltage level |
| 0 | V7 |
| 0.5 | V7 + (V6 − V7) × 9/1175 |
| 1 | V7 + (V6 − V7) × 32/1175 |
| 1.5 | V7 + (V6 − V7) × 76/1175 |
| 2 | V7 + (V6 − V7) × 141/1175 |
| 2.5 | V7 + (V6 − V7) × 224/1175 |
| 3 | V7 + (V6 − V7) × 321/1175 |
| 3.5 | V7 + (V6 − V7) × 425/1175 |
| 4 | V7 + (V6 − V7) × 529/1175 |
| 4.5 | V7 + (V6 − V7) × 630/1175 |
| 5 | V7 + (V6 − V7) × 727/1175 |
| 5.5 | V7 + (V6 − V7) × 820/1175 |
| 6 | V7 + (V6 − V7) × 910/1175 |
| 6.5 | V7 + (V6 − V7) × 998/1175 |
| 7 | V7 + (V6 − V7) × 1086/1175 |

TABLE 6-continued

| Adjusted gray level table from voltage driver | |
|---|---|
| Video level | Grayscale voltage level |
| 7.5 | V6 |
| 8 | V6 + (V5 − V6) × 89/1097 |
| 8.5 | V6 + (V5 − V6) × 173/1097 |
| 9 | V6 + (V5 − V6) × 250/1097 |
| 9.5 | V6 + (V5 − V6) × 320/1097 |
| 10 | V6 + (V5 − V6) × 386/1097 |
| 10.5 | V6 + (V5 − V6) × 451/1097 |
| 11 | V6 + (V5 − V6) × 517/1097 |
| . . . | . . . |
| 125.5 | V1 + (V0 − V1) × 2278/3029 |
| 126 | V1 + (V0 − V1) × 2411/3029 |
| 126.5 | V1 + (V0 − V1) × 2549/3029 |
| 127 | V1 + (V0 − V1) × 2694/3029 |
| 127.5 | V1 + (V0 − V1) × 2851/3029 |
| 128 | V0 |

As it can be seen on FIG. 5, the maximum of video levels are located between level 15 (V5) and level 95 (V2) but this is not the location where the finest gradation is obtained. However, the finest gradation is obtained when reference voltages are near together. This example shows that the gradation obtained with this driver with voltages computed according to the first embodiment is not optimized to this particular line structure.

Therefore, according to a further embodiment there is provided an adaptation of the video transformation and voltage levels to adjust finest gradation where the maximum of video levels are distributed. In order to implement this concept, a first table is needed representing the driver behavior, which means the number of levels represented by each voltage. This is illustrated in Table 7 for the example of Table 1. A full voltage reference table for the driver chosen as example is given in Annex 1.

TABLE 7

| Example of voltage references video rendition | |
|---|---|
| Reference Vn | Amount of levels |
| V7 | 0 |
| V6 | 15 |
| V5 | 16 |
| V4 | 32 |
| V3 | 64 |
| V2 | 64 |
| V1 | 32 |
| V0 | 32 |

It is generally known that a histogram of a picture represents, for each video level, the number of times this level is used. Such a histogram table is computed for a given line and described as HISTO[n], where n represents the possible video levels used for the input picture (at least 8 bit or more). In order to simplify the exposition, an input signal limited to 8-bit (256 discrete levels) will be taken.

Now, the main idea is based on a computation of video level limits for each voltage. Such a limit represents the ideal number of pixels that should be coded inside each voltage. Ideally, this will be based on a percentage of the number of pixels per line. For example, for a display with 720 pixels per lines (720×3 cells) the voltage V5 should be used to encode at least 720×3×16/255=135 cells. Based on this assumption the following Table 8 is obtained.

TABLE 8

| Example of voltage references limitation | | |
|---|---|---|
| Reference Vn | Amount of levels | Limit with 320 cells |
| V7 | 0 | 0 |
| V6 | 15 | 127 |
| V5 | 16 | 135 |
| V4 | 32 | 271 |
| V3 | 64 | 542 |
| V2 | 64 | 542 |
| V1 | 32 | 271 |
| V0 | 32 | 271 |

The limits of this table are stored in an array LIMIT[k] with LIMIT[0]=0, LIMIT[1]=127, . . . , LIMIT[7]=271.

Now, for each line following exemplary computation is performed:

```
LevelCount = 0
Range = 1
For (l=0; l<255; l++)
{
    LevelCount = LevelCount + HISTO[l]
    If (LevelCount > LIMIT[Range])
    {
        LevelCount = 0
        LEVEL_SELECT[Range]=l
        Range++
    }
}
```

From this computation a table of video levels LEVEL_SELECT[k] results that represents the video level at the transition between the voltage k-1 and k. The results for line 303 are given in Table 9 below, which is based on Annex 2.

TABLE 9

| Results of analysis for line 303 | | | |
|---|---|---|---|
| Level | Occurrence | Accumulation | Decision |
| 0 | 27 | 27 | Range 1 |
| 1 | 13 | 40 | Range 1 |
| 2 | 1 | 41 | Range 1 |
| 3 | 2 | 43 | Range 1 |
| 4 | 3 | 46 | Range 1 |
| 5 | 4 | 50 | Range 1 |
| 6 | 3 | 53 | Range 1 |
| 7 | 0 | 53 | Range 1 |
| 8 | 1 | 54 | Range 1 |
| 9 | 1 | 55 | Range 1 |
| 10 | 2 | 57 | Range 1 |
| 11 | 0 | 57 | Range 1 |
| 12 | 5 | 62 | Range 1 |
| 13 | 7 | 69 | Range 1 |
| 14 | 4 | 73 | Range 1 |

TABLE 9-continued

| Results of analysis for line 303 | | | |
|---|---|---|---|
| Level | Occurrence | Accumulation | Decision |
| 15 | 8 | 81 | Range 1 |
| 16 | 9 | 90 | Range 1 |
| 17 | 19 | 109 | Range 1 |
| 18 | 29 | 138 | Range 2 |
| 19 | 50 | 188 | Range 2 |
| 20 | 35 | 223 | Range 2 |
| 21 | 37 | 260 | Range 2 |
| 22 | 24 | 284 | Range 3 |
| 23 | 26 | 310 | Range 3 |
| . . . | . . . | | |
| 116 | 0 | 2149 | Range 7 |
| 117 | 2 | 2151 | Range 7 |
| 118 | 1 | 2152 | Range 7 |
| 119 | 0 | 2152 | Range 7 |
| 120 | 1 | 2153 | Range 7 |
| 121 | 0 | 2153 | Range 7 |
| 122 | 0 | 2153 | Range 7 |
| 123 | 2 | 2155 | Range 7 |
| 124 | 0 | 2155 | Range 7 |
| 125 | 1 | 2156 | Range 7 |
| 126 | 1 | 2157 | Range 7 |
| 127 | 2 | 2159 | Range 7 |
| 128 | 1 | 2160 | Range 7 |

Table 9 shows that:

Levels [0-17] are used in Range 1→voltage V6→LEVEL_SELECT[1]=18

Levels [18-21] are used in Range 2→voltage V5→LEVEL_SELECT[2]=22

Levels [22-31] are used in Range 3→voltage V4→LEVEL_SELECT[3]=32

Levels [32-40] are used in Range 4→voltage V3→LEVEL_SELECT[4]=41

Levels [41-51] are used in Range 5→voltage V2→LEVEL_SELECT[5]=52

Levels [52-60] are used in Range 6→voltage V1→LEVEL_SELECT[6]=61

Levels [61-128] are used in Range 7→voltage V0→LEVEL_SELECT[7]=128

LEVEL_SELECT[0]=0.

Figure 6:
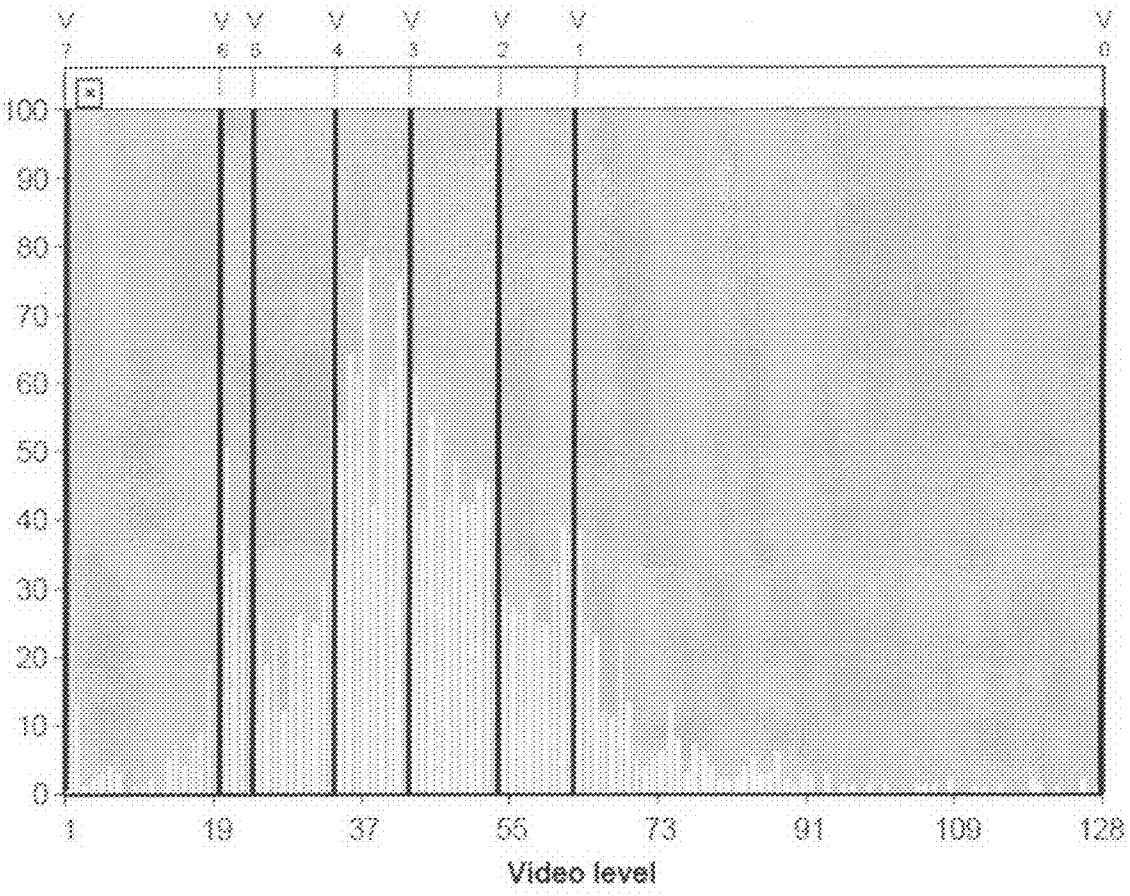
FIG. 6 a histogram of line 303 with optimized reference voltages.

The result is illustrated in FIG. 6 showing a possible optimization of the voltages repartition according to the video levels repartition. The example of algorithm used here for this optimization should be seen as an example since other computations with similar achievements are possible. Indeed, it could be better to reduce a bit more the gap V1 to V0 in the above example. This can be achieved by a more complicated system.

As soon as the optimal voltages repartition for a given line is defined, two types of adjustment should be performed to display a correct but improved picture:

First the adaptation of the voltages themselves—this computation is similar to the computation done in the previous embodiment. In that case the following equation applies:

$$V_n = (Vref_n - Vrefr_{n-1}) \times \left( \frac{\text{LEVEL_SELECT}[n] - \text{LEVEL_SELECT}[n-1]}{\text{LIMIT}[n]} \right) + V_{n-1}$$

with n≥1

Then, the modification of the video levels to suit the new voltages distribution. In that case for a level located in Range n the luminance value is:

$$L_{out} = (L_{in} - \text{LEVEL_SELECT}[n-1]) \times \left(\frac{\text{LIMIT}[n]}{\text{LEVEL_SELECT}[n] - \text{LEVEL_SELECT}[n-1]}\right) + TRANS[n-1]$$

With the table transition being an accumulation of the LIMIT[k] values so that $$TRANS[k] = \sum_{p=0}^{p=k} \text{LIMIT}[k].$$

Consequently, one gets TRANS[0]=0, TRANS[1]=16, TRANS[1]=32, TRANS[2]=64, TRANS[3]=128, TRANS[4]=192, TRANS[5]=224 and TRANS[6]=256.

The results of the previous computations are given in Tables 10 and 11 below:

TABLE 10

| Computed new voltages for line 303 | | |
|---|---|---|
| | Vref | Vline 303 |
| V7 | 0.00 V | 0.00 V |
| V6 | 0.16 V | 0.19 V |
| V5 | 0.30 V | 0.23 V |
| V4 | 0.60 V | 0.32 V |
| V3 | 1.40 V | 0.43 V |
| V2 | 2.20 V | 0.57 V |
| V1 | 2.60 V | 0.68 V |
| V0 | 3.00 V | 1.52 V |

TABLE 11

| Computed new video levels for line 303 | |
|---|---|
| Lin | Lout |
| 0 | 0 |
| 1 | 0.833333 |
| 2 | 1.666667 |
| 3 | 2.5 |
| 4 | 3.333333 |
| 5 | 4.166667 |
| 6 | 5 |
| 7 | 5.833333 |
| 8 | 6.666667 |
| 9 | 7.5 |
| 10 | 8.333333 |

TABLE 11-continued

| Computed new video levels for line 303 | |
|---|---|
| Lin | Lout |
| 11 | 9.166667 |
| 12 | 10 |
| 13 | 10.83333 |
| 14 | 11.66667 |
| 15 | 12.5 |
| 16 | 13.33333 |
| 17 | 14.16667 |
| 18 | 15 |
| . . . | . . . |
| 116 | 249.2687 |
| 117 | 249.7463 |
| 118 | 250.2239 |
| 119 | 250.7015 |
| 120 | 251.1791 |
| 121 | 251.6567 |
| 122 | 252.1343 |
| 123 | 252.6119 |
| 124 | 253.0896 |
| 125 | 253.5672 |
| 126 | 254.0448 |
| 127 | 254.5224 |
| 128 | 255 |

As already explained the complex computations are most of the cases replaced by LUTs. In the situation of the video level adjustment described as:

$$L_{out} = (L_{in} - \text{LEVEL_SELECT}[n-1]) \times \left(\frac{\text{LIMIT}[n]}{\text{LEVEL_SELECT}[n] - \text{LEVEL_SELECT}[n-1]}\right) + TRANS[n-1]$$

A 8-bit LUT takes as input the value LEVEL_SELECT[n]−LEVEL_SELECT[n−1] and delivers a certain factor (more than 10-bit resolution is mandatory) to perform the division. The rest are only multiplications and additions that can be done in real time without any problem.

As already said, the example is related to a simple gamma of 2 in a voltage driven system to simplify the exposition. For a different gamma or for a current driven system, the computations must be adjusted accordingly by using adapted LUTs.

Figure 7:
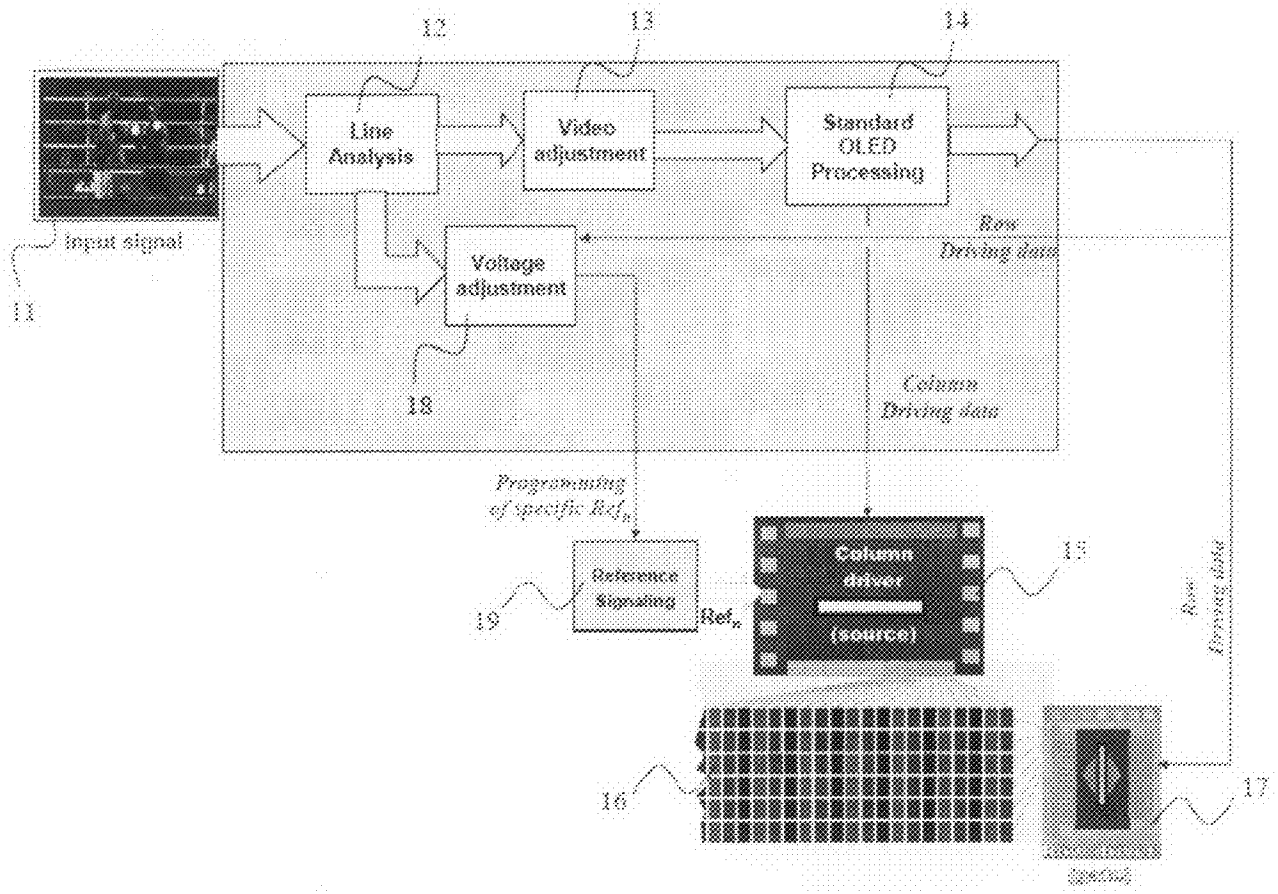
FIG. 7 a block diagram of a hardware embodiment of the present invention.

FIG. 7 illustrates an implementation of the inventive solution. The input signal 11 is forwarded to a line analysis block 12 that performs for each input line the required parameters extraction like the highest video level per line or even histogram analysis. This block 12 requires a line memory to delay the whole process of a line. Indeed, the results of the line analysis are obtained only at the end of the line but the modifications to be done on this line must be performed on the whole line.

After the analysis and the delay of the line, the video levels are adjusted in a video adjustment block 13. Here the new video levels Lout are generated on the basis of the original video levels Lin. The video signal with the new video levels is input to a standard OLED processing unit. 14. Column driving data are output from this unit 14 and transmitted to a column driver 15 of an AMOLED display 16. Furthermore, the standard OLED processing unit 14 produces row driving data for controlling the row driver 17 of the AMOLED display 16.

Analysis data of line analysis block 12 are further provided to a voltage adjustment block 18 for adjusting a reference voltages being provided by a reference signaling unit 19. This reference signaling unit 19 delivers reference voltages $Vref_n$ to the column driver 15. For adjusting the reference voltages, the voltage adjustment block 18 is synchronized onto the row driving unit 17.

The control data for programming the specific reference voltages are forwarded from voltage adjustment block 18 to the reference signaling unit 19. The adaptation of the voltages as well as that of the video levels is done on the basis of LUTs and computation.

In case of a current driven system, the reference signaling is performed with currents and block 18 takes care of a current adjustment.

The invention is not limited to the AMOLED screens but can also be applied to LCD displays or other displays using reference signaling means.

Annex 1 - Full driver voltage table

| Level | Voltage |
|---|---|
| 0 | V7 |
| 1 | V7 + (V6 − V7) × 9/1175 |
| 2 | V7 + (V6 − V7) × 32/1175 |
| 3 | V7 + (V6 − V7) × 76/1175 |
| 4 | V7 + (V6 − V7) × 141/1175 |
| 5 | V7 + (V6 − V7) × 224/1175 |
| 6 | V7 + (V6 − V7) × 321/1175 |
| 7 | V7 + (V6 − V7) × 425/1175 |
| 8 | V7 + (V6 − V7) × 529/1175 |
| 9 | V7 + (V6 − V7) × 630/1175 |
| 10 | V7 + (V6 − V7) × 727/1175 |
| 11 | V7 + (V6 − V7) × 820/1175 |
| 12 | V7 + (V6 − V7) × 910/1175 |
| 13 | V7 + (V6 − V7) × 998/1175 |
| 14 | V7 + (V6 − V7) × 1086/1175 |
| 15 | V6 |
| 16 | V6 + (V5 − V6) × 89/1097 |
| 17 | V6 + (V5 − V6) × 173/1097 |
| 18 | V6 + (V5 − V6) × 250/1097 |
| 19 | V6 + (V5 − V6) × 320/1097 |
| 20 | V6 + (V5 − V6) × 386/1097 |

-continued

Annex 1 - Full driver voltage table

| Level | Voltage |
|---|---|
| 21 | V6 + (V5 − V6) × 451/1097 |
| 22 | V6 + (V5 − V6) × 517/1097 |
| 23 | V6 + (V5 − V6) × 585/1097 |
| 24 | V6 + (V5 − V6) × 654/1097 |
| 25 | V6 + (V5 − V6) × 723/1097 |
| 26 | V6 + (V5 − V6) × 790/1097 |
| 27 | V6 + (V5 − V6) × 855/1097 |
| 28 | V6 + (V5 − V6) × 917/1097 |
| 29 | V6 + (V5 − V6) × 977/1097 |
| 30 | V6 + (V5 − V6) × 1037/1097 |
| 31 | V5 |
| 32 | V5 + (V4 − V5) × 60/1501 |
| 33 | V5 + (V4 − V5) × 119/1501 |
| 34 | V5 + (V4 − V5) × 176/1501 |
| 35 | V5 + (V4 − V5) × 231/1501 |
| 36 | V5 + (V4 − V5) × 284/1501 |
| 37 | V5 + (V4 − V5) × 335/1501 |
| 38 | V5 + (V4 − V5) × 385/1501 |
| 39 | V5 + (V4 − V5) × 434/1501 |
| 40 | V5 + (V4 − V5) × 483/1501 |
| 41 | V5 + (V4 − V5) × 532/1501 |
| 42 | V5 + (V4 − V5) × 580/1501 |
| 43 | V5 + (V4 − V5) × 628/1501 |
| 44 | V5 + (V4 − V5) × 676/1501 |
| 45 | V5 + (V4 − V5) × 724/1501 |
| 46 | V5 + (V4 − V5) × 772/1501 |
| 47 | V5 + (V4 − V5) × 819/1501 |
| 48 | V5 + (V4 − V5) × 866/1501 |
| 49 | V5 + (V4 − V5) × 912/1501 |
| 50 | V5 + (V4 − V5) × 957/1501 |
| 51 | V5 + (V4 − V5) × 1001/1501 |
| 52 | V5 + (V4 − V5) × 1045/1501 |
| 53 | V5 + (V4 − V5) × 1088/1501 |
| 54 | V5 + (V4 − V5) × 1131/1501 |
| 55 | V5 + (V4 − V5) × 1173/1501 |
| 56 | V5 + (V4 − V5) × 1215/1501 |
| 57 | V5 + (V4 − V5) × 1257/1501 |
| 58 | V5 + (V4 − V5) × 1298/1501 |

-continued

Annex 1 - Full driver voltage table

| Level | Voltage |
|---|---|
| 59 | V5 + (V4 − V5) × 1339/1501 |
| 60 | V5 + (V4 − V5) × 1380/1501 |
| 61 | V5 + (V4 − V5) × 1421/1501 |
| 62 | V5 + (V4 − V5) × 1461/1501 |
| 63 | V4 |
| 64 | V4 + (V3 − V4) × 40/2215 |
| 65 | V4 + (V3 − V4) × 80/2215 |
| 66 | V4 + (V3 − V4) × 120/2215 |
| 67 | V4 + (V3 − V4) × 160/2215 |
| 68 | V4 + (V3 − V4) × 200/2215 |
| 69 | V4 + (V3 − V4) × 240/2215 |
| 70 | V4 + (V3 − V4) × 280/2215 |
| 71 | V4 + (V3 − V4) × 320/2215 |
| 72 | V4 + (V3 − V4) × 360/2215 |
| 73 | V4 + (V3 − V4) × 400/2215 |
| 74 | V4 + (V3 − V4) × 440/2215 |
| 75 | V4 + (V3 − V4) × 480/2215 |
| 76 | V4 + (V3 − V4) × 520/2215 |
| 77 | V4 + (V3 − V4) × 560/2215 |
| 78 | V4 + (V3 − V4) × 600/2215 |
| 79 | V4 + (V3 − V4) × 640/2215 |
| 80 | V4 + (V3 − V4) × 680/2215 |
| 81 | V4 + (V3 − V4) × 719/2215 |
| 82 | V4 + (V3 − V4) × 758/2215 |
| 83 | V4 + (V3 − V4) × 796/2215 |
| 84 | V4 + (V3 − V4) × 834/2215 |
| 85 | V4 + (V3 − V4) × 871/2215 |
| 86 | V4 + (V3 − V4) × 908/2215 |
| 87 | V4 + (V3 − V4) × 944/2215 |
| 88 | V4 + (V3 − V4) × 980/2215 |
| 89 | V4 + (V3 − V4) × 1016/2215 |
| 90 | V4 + (V3 − V4) × 1052/2215 |
| 91 | V4 + (V3 − V4) × 1087/2215 |
| 92 | V4 + (V3 − V4) × 1122/2215 |
| 93 | V4 + (V3 − V4) × 1157/2215 |
| 94 | V4 + (V3 − V4) × 1192/2215 |
| 95 | V4 + (V3 − V4) × 1226/2215 |
| 96 | V4 + (V3 − V4) × 1260/2215 |
| 97 | V4 + (V3 − V4) × 1294/2215 |

-continued

Annex 1 - Full driver voltage table

| Level | Voltage |
|---|---|
| 98 | V4 + (V3 − V4) × 1328/2215 |
| 99 | V4 + (V3 − V4) × 1362/2215 |
| 100 | V4 + (V3 − V4) × 1396/2215 |
| 101 | V4 + (V3 − V4) × 1429/2215 |
| 102 | V4 + (V3 − V4) × 1462/2215 |
| 103 | V4 + (V3 − V4) × 1495/2215 |
| 104 | V4 + (V3 − V4) × 1528/2215 |
| 105 | V4 + (V3 − V4) × 1561/2215 |
| 106 | V4 + (V3 − V4) × 1593/2215 |
| 107 | V4 + (V3 − V4) × 1625/2215 |
| 108 | V4 + (V3 − V4) × 1657/2215 |
| 109 | V4 + (V3 − V4) × 1688/2215 |
| 110 | V4 + (V3 − V4) × 1719/2215 |
| 111 | V4 + (V3 − V4) × 1750/2215 |
| 112 | V4 + (V3 − V4) × 1781/2215 |
| 113 | V4 + (V3 − V4) × 1811/2215 |
| 114 | V4 + (V3 − V4) × 1841/2215 |
| 115 | V4 + (V3 − V4) × 1871/2215 |
| 116 | V4 + (V3 − V4) × 1901/2215 |
| 117 | V4 + (V3 − V4) × 1930/2215 |
| 118 | V4 + (V3 − V4) × 1959/2215 |
| 119 | V4 + (V3 − V4) × 1988/2215 |
| 120 | V4 + (V3 − V4) × 2016/2215 |
| 121 | V4 + (V3 − V4) × 2044/2215 |
| 122 | V4 + (V3 − V4) × 2072/2215 |
| 123 | V4 + (V3 − V4) × 2100/2215 |
| 124 | V4 + (V3 − V4) × 2128/2215 |
| 125 | V4 + (V3 − V4) × 2156/2215 |
| 126 | V4 + (V3 − V4) × 2185/2215 |
| 127 | V3 |
| 128 | V3 + (V2 − V3) × 31/2343 |
| 129 | V3 + (V2 − V3) × 64/2343 |
| 130 | V3 + (V2 − V3) × 97/2343 |
| 131 | V3 + (V2 − V3) × 130/2343 |
| 132 | V3 + (V2 − V3) × 163/2343 |
| 133 | V3 + (V2 − V3) × 196/2343 |
| 134 | V3 + (V2 − V3) × 229/2343 |
| 135 | V3 + (V2 − V3) × 262/2343 |
| 136 | V3 + (V2 − V3) × 295/2343 |

-continued

Annex 1 - Full driver voltage table

| Level | Voltage |
|---|---|
| 137 | V3 + (V2 − V3) × 328/2343 |
| 138 | V3 + (V2 − V3) × 361/2343 |
| 139 | V3 + (V2 − V3) × 395/2343 |
| 140 | V3 + (V2 − V3) × 429/2343 |
| 141 | V3 + (V2 − V3) × 463/2343 |
| 142 | V3 + (V2 − V3) × 497/2343 |
| 143 | V3 + (V2 − V3) × 531/2343 |
| 144 | V3 + (V2 − V3) × 566/2343 |
| 145 | V3 + (V2 − V3) × 601/2343 |
| 146 | V3 + (V2 − V3) × 636/2343 |
| 147 | V3 + (V2 − V3) × 671/2343 |
| 148 | V3 + (V2 − V3) × 706/2343 |
| 149 | V3 + (V2 − V3) × 741/2343 |
| 150 | V3 + (V2 − V3) × 777/2343 |
| 151 | V3 + (V2 − V3) × 813/2343 |
| 152 | V3 + (V2 − V3) × 849/2343 |
| 153 | V3 + (V2 − V3) × 885/2343 |
| 154 | V3 + (V2 − V3) × 921/2343 |
| 155 | V3 + (V2 − V3) × 958/2343 |
| 156 | V3 + (V2 − V3) × 995/2343 |
| 157 | V3 + (V2 − V3) × 1032/2343 |
| 158 | V3 + (V2 − V3) × 1069/2343 |
| 159 | V3 + (V2 − V3) × 1106/2343 |
| 160 | V3 + (V2 − V3) × 1143/2343 |
| 161 | V3 + (V2 − V3) × 1180/2343 |
| 162 | V3 + (V2 − V3) × 1217/2343 |
| 163 | V3 + (V2 − V3) × 1255/2343 |
| 164 | V3 + (V2 − V3) × 1293/2343 |
| 165 | V3 + (V2 − V3) × 1331/2343 |
| 166 | V3 + (V2 − V3) × 1369/2343 |
| 167 | V3 + (V2 − V3) × 1407/2343 |
| 168 | V3 + (V2 − V3) × 1445/2343 |
| 169 | V3 + (V2 − V3) × 1483/2343 |
| 170 | V3 + (V2 − V3) × 1521/2343 |
| 171 | V3 + (V2 − V3) × 1559/2343 |
| 172 | V3 + (V2 − V3) × 1597/2343 |
| 173 | V3 + (V2 − V3) × 1635/2343 |

-continued

Annex 1 - Full driver voltage table

| Level | Voltage |
|---|---|
| 174 | V3 + (V2 − V3) × 1673/2343 |
| 175 | V3 + (V2 − V3) × 1712/2343 |
| 176 | V3 + (V2 − V3) × 1751/2343 |
| 177 | V3 + (V2 − V3) × 1790/2343 |
| 178 | V3 + (V2 − V3) × 1829/2343 |
| 179 | V3 + (V2 − V3) × 1868/2343 |
| 180 | V3 + (V2 − V3) × 1907/2343 |
| 181 | V3 + (V2 − V3) × 1946/2343 |
| 182 | V3 + (V2 − V3) × 1985/2343 |
| 183 | V3 + (V2 − V3) × 2024/2343 |
| 184 | V3 + (V2 − V3) × 2064/2343 |
| 185 | V3 + (V2 − V3) × 2103/2343 |
| 186 | V3 + (V2 − V3) × 2143/2343 |
| 187 | V3 + (V2 − V3) × 2183/2343 |
| 188 | V3 + (V2 − V3) × 2223/2343 |
| 189 | V3 + (V2 − V3) × 2263/2343 |
| 190 | V3 + (V2 − V3) × 2303/2343 |
| 191 | V2 |
| 192 | V2 + (V1 − V2) × 40/1638 |
| 193 | V2 + (V1 − V2) × 81/1638 |
| 194 | V2 + (V1 − V2) × 124/1638 |
| 195 | V2 + (V1 − V2) × 168/1638 |
| 196 | V2 + (V1 − V2) × 213/1638 |
| 197 | V2 + (V1 − V2) × 259/1638 |
| 198 | V2 + (V1 − V2) × 306/1638 |
| 199 | V2 + (V1 − V2) × 353/1638 |
| 200 | V2 + (V1 − V2) × 401/1638 |
| 201 | V2 + (V1 − V2) × 450/1638 |
| 202 | V2 + (V1 − V2) × 499/1638 |
| 203 | V2 + (V1 − V2) × 548/1638 |
| 204 | V2 + (V1 − V2) × 597/1638 |
| 205 | V2 + (V1 − V2) × 646/1638 |
| 206 | V2 + (V1 − V2) × 695/1638 |
| 207 | V2 + (V1 − V2) × 745/1638 |
| 208 | V2 + (V1 − V2) × 795/1638 |
| 209 | V2 + (V1 − V2) × 846/1638 |
| 210 | V2 + (V1 − V2) × 897/1638 |
| 211 | V2 + (V1 − V2) × 949/1638 |
| 212 | V2 + (V1 − V2) × 1002/1638 |

-continued

Annex 1 - Full driver voltage table

| Level | Voltage |
|---|---|
| 213 | V2 + (V1 − V2) × 1056/1638 |
| 214 | V2 + (V1 − V2) × 1111/1638 |
| 215 | V2 + (V1 − V2) × 1167/1638 |
| 216 | V2 + (V1 − V2) × 1224/1638 |
| 217 | V2 + (V1 − V2) × 1281/1638 |
| 218 | V2 + (V1 − V2) × 1339/1638 |
| 219 | V2 + (V1 − V2) × 1398/1638 |
| 220 | V2 + (V1 − V2) × 1458/1638 |
| 221 | V2 + (V1 − V2) × 1518/1638 |
| 222 | V2 + (V1 − V2) × 1578/1638 |
| 223 | V1 |
| 224 | V1 + (V0 − V1) × 60/3029 |
| 225 | V1 + (V0 − V1) × 120/3029 |
| 226 | V1 + (V0 − V1) × 180/3029 |
| 227 | V1 + (V0 − V1) × 241/3029 |
| 228 | V1 + (V0 − V1) × 304/3029 |
| 229 | V1 + (V0 − V1) × 369/3029 |
| 230 | V1 + (V0 − V1) × 437/3029 |
| 231 | V1 + (V0 − V1) × 507/3029 |
| 232 | V1 + (V0 − V1) × 580/3029 |
| 233 | V1 + (V0 − V1) × 655/3029 |
| 234 | V1 + (V0 − V1) × 732/3029 |
| 235 | V1 + (V0 − V1) × 810/3029 |
| 236 | V1 + (V0 − V1) × 889/3029 |
| 237 | V1 + (V0 − V1) × 969/3029 |
| 238 | V1 + (V0 − V1) × 1050/3029 |
| 239 | V1 + (V0 − V1) × 1133/3029 |
| 240 | V1 + (V0 − V1) × 1218/3029 |
| 241 | V1 + (V0 − V1) × 1304/3029 |
| 242 | V1 + (V0 − V1) × 1393/3029 |
| 243 | V1 + (V0 − V1) × 1486/3029 |
| 244 | V1 + (V0 − V1) × 1583/3029 |
| 245 | V1 + (V0 − V1) × 1686/3029 |
| 246 | V1 + (V0 − V1) × 1794/3029 |
| 247 | V1 + (V0 − V1) × 1907/3029 |
| 248 | V1 + (V0 − V1) × 2026/3029 |
| 249 | V1 + (V0 − V1) × 2150/3029 |
| 250 | V1 + (V0 − V1) × 2278/3029 |

-continued

Annex 1 - Full driver voltage table

| Level | Voltage |
|---|---|
| 251 | V1 + (V0 − V1) × 2411/3029 |
| 252 | V1 + (V0 − V1) × 2549/3029 |
| 253 | V1 + (V0 − V1) × 2694/3029 |
| 254 | V1 + (V0 − V1) × 2851/3029 |
| 255 | V0 |

Annex 2 - Histogram of line 303 from sequence "Zorro"

| Level | Occurrence |
|---|---|
| 0 | 27 |
| 1 | 13 |
| 2 | 1 |
| 3 | 2 |
| 4 | 3 |
| 5 | 4 |
| 6 | 3 |
| 7 | 0 |
| 8 | 1 |
| 9 | 1 |
| 10 | 2 |
| 11 | 0 |
| 12 | 5 |
| 13 | 7 |
| 14 | 4 |
| 15 | 8 |
| 16 | 9 |
| 17 | 19 |
| 18 | 29 |
| 19 | 50 |
| 20 | 35 |
| 21 | 37 |
| 22 | 24 |
| 23 | 26 |
| 24 | 19 |
| 25 | 23 |
| 26 | 12 |
| 27 | 24 |
| 28 | 26 |
| 29 | 23 |
| 30 | 25 |
| 31 | 31 |
| 32 | 56 |
| 33 | 54 |
| 34 | 64 |
| 35 | 61 |
| 36 | 78 |
| 37 | 42 |
| 38 | 59 |
| 39 | 61 |
| 40 | 75 |
| 41 | 78 |
| 42 | 61 |
| 43 | 41 |
| 44 | 55 |
| 45 | 52 |
| 46 | 43 |
| 47 | 48 |
| 48 | 42 |
| 49 | 42 |
| 50 | 46 |
| 51 | 45 |
| 52 | 28 |
| 53 | 29 |
| 54 | 27 |
| 55 | 26 |
| 56 | 28 |
| 57 | 25 |

-continued

Annex 2 - Histogram of line 303 from sequence "Zorro"

| Level | Occurrence |
|---|---|
| 58 | 25 |
| 59 | 33 |
| 60 | 39 |
| 61 | 38 |
| 62 | 38 |
| 63 | 25 |
| 64 | 23 |
| 65 | 12 |
| 66 | 11 |
| 67 | 22 |
| 68 | 13 |
| 69 | 5 |
| 70 | 4 |
| 71 | 5 |
| 72 | 6 |
| 73 | 13 |
| 74 | 8 |
| 75 | 3 |
| 76 | 7 |
| 77 | 6 |
| 78 | 4 |
| 79 | 2 |
| 80 | 2 |
| 81 | 2 |
| 82 | 4 |
| 83 | 5 |
| 84 | 3 |
| 85 | 3 |
| 86 | 6 |
| 87 | 2 |
| 88 | 1 |
| 89 | 3 |
| 90 | 2 |
| 91 | 0 |
| 92 | 3 |
| 93 | 0 |
| 94 | 1 |
| 95 | 1 |
| 96 | 0 |
| 97 | 1 |
| 98 | 0 |
| 99 | 1 |
| 100 | 0 |
| 101 | 0 |
| 102 | 0 |
| 103 | 1 |
| 104 | 1 |
| 105 | 1 |
| 106 | 0 |
| 107 | 2 |
| 108 | 0 |
| 109 | 0 |
| 110 | 1 |
| 111 | 1 |
| 112 | 0 |
| 113 | 1 |
| 114 | 0 |
| 115 | 0 |
| 116 | 0 |
| 117 | 2 |
| 118 | 1 |
| 119 | 0 |
| 120 | 1 |
| 121 | 0 |
| 122 | 0 |
| 123 | 2 |
| 124 | 0 |
| 125 | 1 |
| 126 | 1 |
| 127 | 2 |
| 128 | 1 |
| 129 | 0 |
| 130 | 0 |
| 131 | 0 |
| 132 | 0 |

-continued

Annex 2 - Histogram of line 303 from sequence "Zorro"

| Level | Occurrence |
|---|---|
| 133 | 0 |
| 134 | 0 |
| 135 | 0 |
| 136 | 0 |
| 137 | 0 |
| 138 | 0 |
| 139 | 0 |
| 140 | 0 |
| 141 | 0 |
| 142 | 0 |
| 143 | 0 |
| 144 | 0 |
| 145 | 0 |
| 146 | 0 |
| 147 | 0 |
| 148 | 0 |
| 149 | 0 |
| 150 | 0 |
| 151 | 0 |
| 152 | 0 |
| 153 | 0 |
| 154 | 0 |
| 155 | 0 |
| 156 | 0 |
| 157 | 0 |
| 158 | 0 |
| 159 | 0 |
| 160 | 0 |
| 161 | 0 |
| 162 | 0 |
| 163 | 0 |
| 164 | 0 |
| 165 | 0 |
| 166 | 0 |
| 167 | 0 |
| 168 | 0 |
| 169 | 0 |
| 170 | 0 |
| 171 | 0 |
| 172 | 0 |
| 173 | 0 |
| 174 | 0 |
| 175 | 0 |
| 176 | 0 |
| 177 | 0 |
| 178 | 0 |
| 179 | 0 |
| 180 | 0 |
| 181 | 0 |
| 182 | 0 |
| 183 | 0 |
| 184 | 0 |
| 185 | 0 |
| 186 | 0 |
| 187 | 0 |
| 188 | 0 |
| 189 | 0 |
| 190 | 0 |
| 191 | 0 |
| 192 | 0 |
| 193 | 0 |
| 194 | 0 |
| 195 | 0 |
| 196 | 0 |
| 197 | 0 |
| 198 | 0 |
| 199 | 0 |
| 200 | 0 |
| 201 | 0 |
| 202 | 0 |
| 203 | 0 |
| 204 | 0 |
| 205 | 0 |
| 206 | 0 |
| 207 | 0 |

-continued

| Annex 2 - Histogram of line 303 from sequence "Zorro" | |
|---|---|
| Level | Occurrence |
| 208 | 0 |
| 209 | 0 |
| 210 | 0 |
| 211 | 0 |
| 212 | 0 |
| 213 | 0 |
| 214 | 0 |
| 215 | 0 |
| 216 | 0 |
| 217 | 0 |
| 218 | 0 |
| 219 | 0 |
| 220 | 0 |
| 221 | 0 |
| 222 | 0 |
| 223 | 0 |
| 224 | 0 |
| 225 | 0 |
| 226 | 0 |
| 227 | 0 |
| 228 | 0 |
| 229 | 0 |
| 230 | 0 |
| 231 | 0 |
| 232 | 0 |
| 233 | 0 |
| 234 | 0 |
| 235 | 0 |
| 236 | 0 |
| 237 | 0 |
| 238 | 0 |
| 239 | 0 |
| 240 | 0 |
| 241 | 0 |
| 242 | 0 |
| 243 | 0 |
| 244 | 0 |
| 245 | 0 |
| 246 | 0 |
| 247 | 0 |
| 248 | 0 |
| 249 | 0 |
| 250 | 0 |
| 251 | 0 |
| 252 | 0 |
| 253 | 0 |
| 254 | 0 |
| 255 | 0 |

The invention claimed is:

1. Method for driving a display device with at least one variable reference driving signal for displaying video level with variable video depth, comprising:

providing a digital value as video level for each pixel or cell of a line of said display device, providing at least one reference driving signal and generating a driving signal on the basis of said digital value and said at least one reference driving signal, adjusting said at least one reference driving signal dependent on a change of digital values of video levels of at least a part of said line representing a range of video levels by a transformation of said range of video levels of said line to a maximum number of available video levels for displaying video levels with variable video depth to perform a picture line-dependent alteration of a number of gradations by adjusting said at least one reference driving signal to the video levels in said at least part of said line and a number of video levels corresponding to said range of video levels for displaying video level with variable video depth and original luminance on the display device.

2. Method according to claim 1, wherein said display device is one of an AMOLED display and a LCD display.

3. Method according to claim 1, wherein said reference driving signal is one of a reference voltage and a reference current.

4. Method according to claim 1, wherein a maximum digital value of said at least part of a line is determined and when adjusting said at least one reference driving signal, said at least one reference driving signal is assigned to digital values between a minimum digital value which is to be determined or is predetermined, and said maximum digital value.

5. Method according to claim 1, wherein a histogram of the digital values of said at least part of a line is determined and said at least one reference driving signal is adjusted on the basis of said histogram.

6. Apparatus for driving a display device with at least one variable reference driving signal for displaying video level with variable video depth including an input for receiving a digital value for each pixel or cell of a line of said display device, a reference signaling unit for providing at least one reference driving signal and a driver for generating a driving signal on the basis of said digital value and said at least one reference driving signal, an adjustment block for adjusting said at least one reference driving signal in dependence of a range of video levels representative of the digital values of video levels of at least a part of said line, a line analysis block providing for each input line the highest video level for said at least part of said line and a video adjustment block to generate new video levels on the basis of said range of video levels according to a maximum number of available video levels for displaying video level with variable video depth, wherein said adjustment block is connected to said line analysis block to perform a picture line-dependent alteration of a number of gradations by adjusting said at least one reference driving signal being provided by a reference signaling unit to the video levels in said at least part of said line for driver reference signaling a number of video levels corresponding to said range of video levels for displaying video level with variable video depth and original luminance on the display device.

7. Apparatus according to claim 6, wherein said display device is one of an AMOLED display and a LCD display.

8. Apparatus according to claim 6, wherein said reference signaling unit provides ones of reference voltages and reference currents as reference driving signal.

9. Apparatus according to claim 6, wherein said line analysis block further determines a maximum digital value of said at least part of a line and for providing said maximum digital value to said adjustment block, so that said adjustment block is capable of assigning said at least one reference driving signal to digital values between a minimum digital value, which is to be determined or is predetermined, and said maximum digital value.

10. Apparatus according to claim 6, wherein said line analysis block further determines a histogram of the digital values of said at least part of a line and for controlling said adjustment block so that said at least one reference driving signal is adjusted on the basis of said histogram.

* * * * *